US009334133B2

(12) United States Patent
Nordling et al.

(10) Patent No.: US 9,334,133 B2
(45) Date of Patent: May 10, 2016

(54) SHEET FEEDER WITH DUAL DISCHARGE

(71) Applicant: MULTIFEEDER TECHNOLOGIES, INC., White Bear Lake, MN (US)

(72) Inventors: Peter M. Nordling, Shoreview, MN (US); Edward J. Turin, Eagan, MN (US)

(73) Assignee: Multifeeder Technologies, Inc., White Bear Lake, MN (US)

( * ) Notice: Subject to any disclaimer, the term of this patent is extended or adjusted under 35 U.S.C. 154(b) by 0 days.

(21) Appl. No.: 14/409,825

(22) PCT Filed: Jun. 25, 2013

(86) PCT No.: PCT/US2013/047482

§ 371 (c)(1),
(2) Date: Dec. 19, 2014

(87) PCT Pub. No.: WO2014/004429

PCT Pub. Date: Jan. 3, 2014

(65) Prior Publication Data

US 2015/0197406 A1 Jul. 16, 2015

Related U.S. Application Data

(60) Provisional application No. 61/665,396, filed on Jun. 28, 2012.

(51) Int. Cl.

| | |
|---|---|
| ***B65H 7/02*** | (2006.01) |
| ***B65H 39/14*** | (2006.01) |
| ***B65H 3/04*** | (2006.01) |
| ***B65H 5/02*** | (2006.01) |
| ***B65H 9/00*** | (2006.01) |
| ***B65H 9/06*** | (2006.01) |

(52) U.S. Cl.

CPC ..... *B65H 7/02* (2013.01); *B65H 3/042* (2013.01); *B65H 5/02* (2013.01); *B65H 5/023* (2013.01);

(Continued)

(58) Field of Classification Search

CPC ..... B65H 5/16; B65H 5/34; B65H 5/021; B65H 5/023; B65H 9/02; B65H 9/06; B65H 9/10; B65H 9/101; B65H 9/12; B65H 9/103; B65H 9/106; B65H 2301/361; B65H 2301/4355; B65H 2301/4422; B65H 2301/4452; B65H 2301/4475; B65H 2301/4476; B65H 2301/516; B65H 2404/231; B65H 2404/2311; B65H 2404/232; B65H 2404/2321; B65H 2404/2322; B65H 2404/722; B65H 2801/75; B65H 39/14; B65H 37/002; B65H 37/04; B65H 3/042; B65H 29/12

See application file for complete search history.

(56) References Cited

U.S. PATENT DOCUMENTS 4,082,595 A 4/1978 Slater
4,270,967 A * 6/1981 Cone ..... 156/299

(Continued)

*Primary Examiner* — Ernesto Suarez
(74) *Attorney, Agent, or Firm* — Nikolai & Mersereau PA; Thomas J. Nikolai

(57) ABSTRACT

A sheet feeder feeds product, one at a time, from the bottom of a stack onto a second stage discharge conveyor in which the serialized products are brought into precise registration prior to being deposited onto a moving web. To achieve registration, the products are transported at a higher rate than the speed of a pair of timing belts having regularly spaced lugs projecting therefrom. The lug timing belts are positioned beneath the belts transporting the product with the lugs projecting into the product's path of travel. The speed deference is that a leading edge of the products is brought into engagement with the trailing edge of a laterally aligned pair of lugs before the product arrives at the discharge point of the second stage discharge conveyor. The transport rate on the second stage discharge conveyor is controlled to match the speed of the moving web.

3 Claims, 5 Drawing Sheets

(52) U.S. Cl.
CPC .. *B65H 9/00* (2013.01); *B65H 9/06* (2013.01); *B65H 39/14* (2013.01); *B65H 2404/232* (2013.01); *B65H 2404/2691* (2013.01); *B65H 2701/1764* (2013.01)

(56) References Cited

U.S. PATENT DOCUMENTS 4,359,214 A 11/1982 Eldridge
4,373,986 A * 2/1983 Cone ..... 156/552
5,039,086 A * 8/1991 Matsuno et al. ..... 271/227
5,653,671 A 8/1997 Reuteler
6,050,563 A * 4/2000 Vedoy et al. ..... 271/10.07
6,293,544 B1 * 9/2001 Fedinatz ..... 271/243
7,040,613 B2 * 5/2006 Vedoy ..... 271/10.07
7,588,239 B2 * 9/2009 Marcinik et al. ..... 270/52.18
7,942,398 B1 * 5/2011 Marcinik ..... 270/58.01
8,419,879 B2 * 4/2013 Rickli ..... 156/230
2009/0044492 A1 2/2009 Howell et al.
2009/0090469 A1 * 4/2009 Painter et al. ..... 156/362

* cited by examiner

SHEET FEEDER WITH DUAL DISCHARGE

CROSS REFERENCE TO RELATED APPLICATION

This application is a 371 of International Application No. PCT/US2013/047482, filed 25 Jun. 2013, and claims priority from that application which is also deemed incorporated by reference in its entirety in this application.

BACKGROUND OF THE INVENTION

1. Field of the Invention

This invention relates generally to equipment for feeding sheets, one at a time, from a stack in a hopper, and more particularly to a sheet feeder incorporating a second discharge stage that receives sheets serially from the sheet feeder and properly registers and aligns the sheets for precision placement on a moving web.

2. Discussion of the Prior Art

Longford International, Ltd. has, for several years, been marketing its Model OS700 surge feeder to the offset printing industry for feeding label stock to the input pinch point of a web press to create multilayer labels. The OS700 machine comprises a sheet feeder for dispensing sheets, one at a time, from a supply stack and a discharge conveyor for aligning and registering the individual sheets for accurate placement on a moving film web at a rate of about 10 per second.

The discharge conveyor of the OS700 machine comprises a pair of parallel, endless chains deployed about spaced-apart drive shaft sprockets proximate the discharge end of the sheet feeder and a pair of spaced-apart driver or idler shaft sprockets proximate a pinch point of the film web transport. Each of the endless chains carries a plurality of regularly-spaced lugs along the length of the chains. The lugs attach to the chain by a hinge mechanism that allows a pair of transversely aligned lugs (one on each chain) to drop straight down in unison just before reaching the idler shaft sprockets. That is to say, the lugs do not simply project normal to the chain as they round the idler shaft sprockets. This is to ensure that the lugs do not strike and damage the sheets being fed onto the downstream film web. The mechanism for effecting the desired downward movement of the chain lugs comprises several parts and is relatively expensive.

In operation, as the sheets are ejected from the sheet feeder onto the discharge conveyor, the lugs engage the trailing edge of the sheets and push the sheets along their path of travel. Because the lugs on the Longford machine effectively push the product as its trailing edge, it is unable to handle products that have features, such as tails or tabs that extend from the product's trailing edge.

Our invention is designed to be an improvement over the discharge conveyor used on the Longford OS700 surge feeder in that it eliminates the need for lugged chains for achieving registration and alignment of the sheets. It especially eliminates the complex hinging mechanism needed in the Longford OS700 machine to cause the lugs on adjacent chains to drop down in unison to avoid damage to the sheets being fed as they move from the discharge conveyor stage to the pinch point of the web press. Furthermore, in our invention lugs do not push against a product's trailing edge so our machine is able to handle products that the Longford machine cannot.

SUMMARY OF THE INVENTION

In accordance with the present invention, there is provided is a two-stage discharge conveyor where the first stage feeds sheets from a stack using feeder stripper wheels and between flights of upper and lower motor-driven belts to a second stage discharge conveyor. The second stage discharge conveyor includes an upper and a lower set of endless transport belts that frictionally engage sheets between a lower belt flight of the upper set and an upper belt flight of the lower set where the upper and lower sets are driven at the same speed. Located beneath the aforementioned belt sets is a separately driven pair of endless timing belts having regularly spaced integrally formed lugs projecting normally from a surface thereof and upward beyond the lower set of transport belts. The lugged endless belts have their nose rollers positioned rearward of the nose rollers of the upper and lower transport belt sets and, thus, the lugged belts traverse their nose rollers before reaching the point where the sheets being fed leave the second stage discharge conveyor onto a moving web and therefore the lugs cannot engage and thereby damage the sheets as they leave the second stage discharge conveyor.

Additionally, rather than using the lugged chains to push sheets as in the Longford OS700 machine, an appropriate ratio is maintained between the speed at which the sheet transport belts are driven and the speed at which the lugged belts are driven and whereby the transport belts move at a slightly greater speed than the lugged belts. As a result, the sheets leaving the first discharge conveyor stage with irregular spacing therebetween are advanced along the path of travel, ultimately reaching a point where the leading edge of the sheets abut a pair of laterally aligned lugs on adjacent lugged belts so as to become evenly spaced and "squared" with respect to a discharge end of the sheet transport belts. Because of our improved design, our machine can practically double the minimal throughput of the Longford OS700 Surge Feeder.

DESCRIPTION OF THE DRAWINGS

The foregoing features, object and advantages of the invention will become apparent to those skilled in the art from the following detailed description of a preferred embodiment, especially when considered in conjunction with the accompanying photographs in which.

DESCRIPTION OF THE PREFERRED EMBODIMENT

Figure 1:
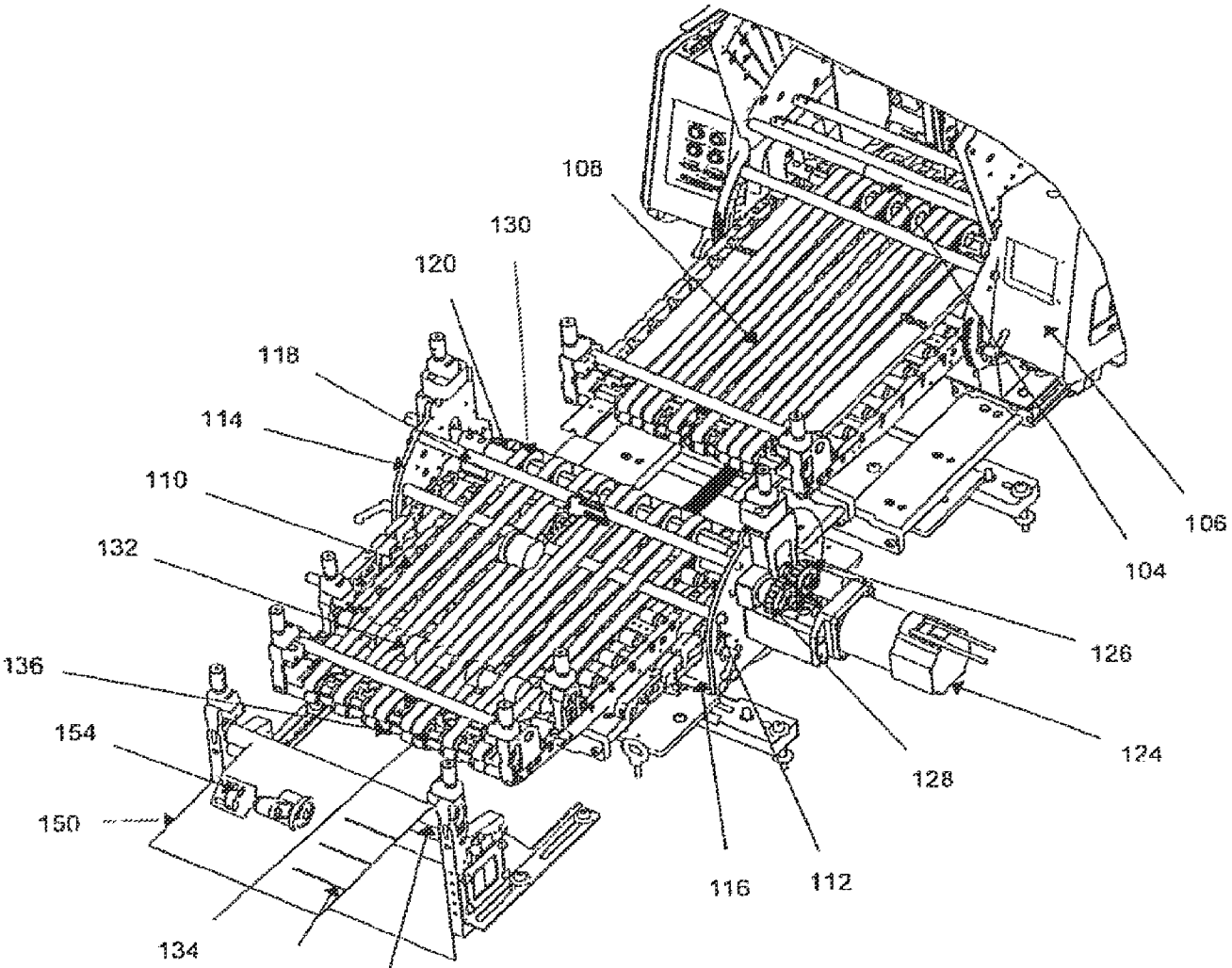
FIG. 1 is a perspective view of a dual-discharge sheet feeder incorporating the present invention and taken from a front, right location.

This description of the preferred embodiments is intended to be read in connection with the accompanying photos, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the photos under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

U.S. Pat. No. 6,050,563 to Vedoy describes, in detail, a sheet feeder which comprises a component of the present invention. The '563 patent and the Vedoy U.S. Pat. No. 7,050,613 are hereby incorporated by reference as if fully set forth herein. These two patents fully describe how sheets contained in a stack are stripped, one-at-a-time, from the bottom of the stack and fed through a discharge stage 58 to a pinch point between nose rollers on shafts 71 and 76 where the reference numerals are those used in the '563 patent.

Even though in designing the sheet feeder an effort is made to eject sheets at a constant rate, it is difficult to achieve this result. In many applications for sheet feeders of the type described in the Vedoy references, irregularity in both spacing and orientation can be tolerated, but other applications demand much greater precision. For example, when it is desired to deliver printed, multi-page labels to a moving web for later use by automated package labeling machines, it is imperative that the printed labels be dispensed onto the moving high web at a rate and at a placement that ensures extremely close tolerance spacing between adjacent labels, and that labels be accurately aligned with registration marks on the web. In accordance with the present invention, this is achieved by providing a motor-driven, second stage, discharge conveyor, described below, at the output end of the discharge stage identified by numeral 58 of the Vedoy '563 patent.

Shown in FIG. 1 of the present application is a support bar 100 made from aluminum extrusions and adapted to be attached to a frame (not shown) supported on legs at a desired working height. Placed atop the support bar 100 and the frame is a sheet feeder of a type fully described in the aforereferenced Vedoy patent indicated generally by numeral 104 and whose controller module is labeled 106.

The MFT 350 sheet feeder sold commercially by applicants' assignee can be used as the sheet feeder 104 in the practice of the present invention. Located downstream of the first stage discharge conveyor 108 of the sheet feeder 104 is a second stage discharge conveyor, indicated generally at 110.

Figure 2:
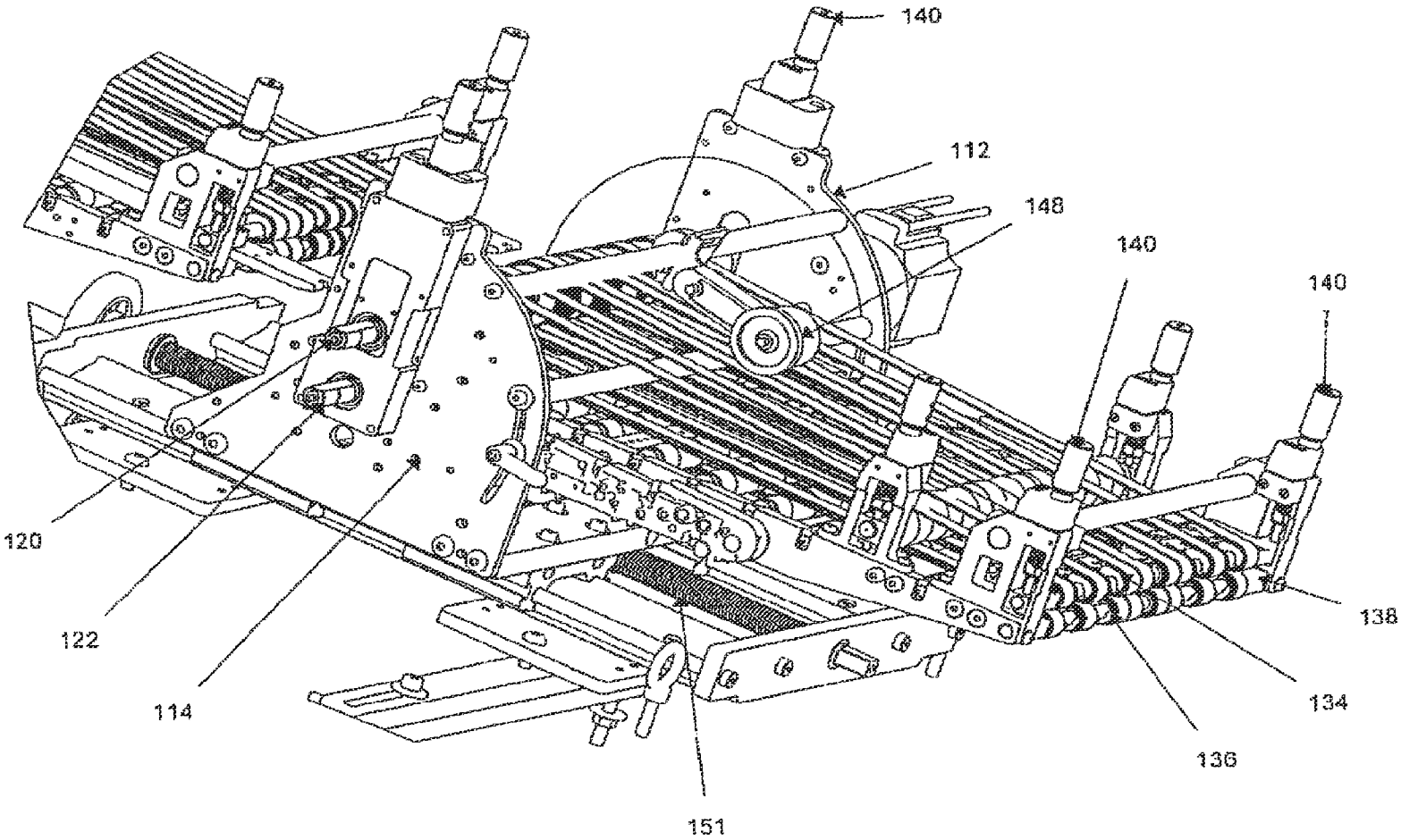
FIG. 2 is a perspective view like that of FIG. 1 but taken from a left, front location.

The second stage discharge conveyor comprises a pair of side plates 112 and 114 bolted to a base plate 116 and held in parallel, spaced relation by an upper support rod 118. Disposed below the support rod 118 and journaled for rotation in bearings affixed to the side plates 112 and 114 is an upper drive shaft 120 and a lower drive shaft 122 (FIG. 2).

The shafts 120 and 122 are adapted to be driven by a servo motor 124 (FIG. 1) that is rigidly mounted to side plate 112, via a gear box transmission including belt driven meshed spur drive gears 126 and 128. The gears 126 and 128 have deep roots which allow for spacing adjustment between the parallel shafts 120 and 122 without disengagement of the drive gears 126 and 128 from one another. This allows the pressure between the upper and lower transport belt sets to be adjusted using vernier adjustment screws 140.

Figure 4:
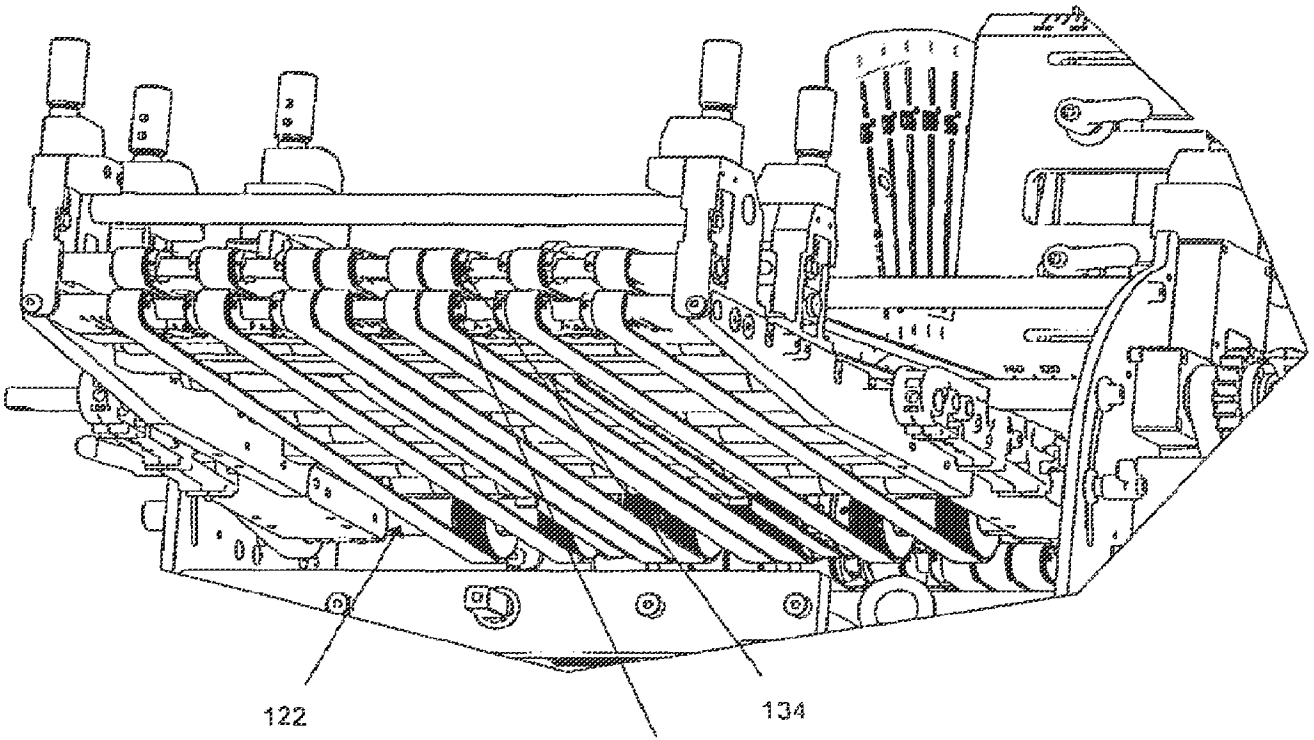
FIG. 4 is a close-up, front view of the machine depicted in FIG. 1.

Affixed to the upper drive shaft 120 are a plurality of sheaves, as at 130, about which are disposed an upper set of endless friction belts. The belts extend around shaft mounted idler rollers, at 132, and about shaft mounted upper nose rollers as at 134. In a similar fashion, the second stage discharge conveyor includes a lower set of friction belts similarly deployed about the sheaves on the lower drive shaft 122 (FIG. 4) and about nose rollers 136 on a idler shaft 138 (FIG. 2).

The upper friction transport belt set overlays the lower friction transport belt set such that the lower flight of the upper belt set closely align with the upper flight of the lower belt set and where the gap therebetween is adjustable by means of veneer screw knobs, 140 to accommodate products of different thickness dimensions.

It should be apparent from what has been described and from the teachings of the Vedoy patent that as the upper and lower drive shafts are rotated, sheet products captured between the lower flight of the upper transport belt set and the upper flight of the lower transport belt set will be carried forward until exiting at the pinch point of nose rollers 134 and 136.

Figure 3:
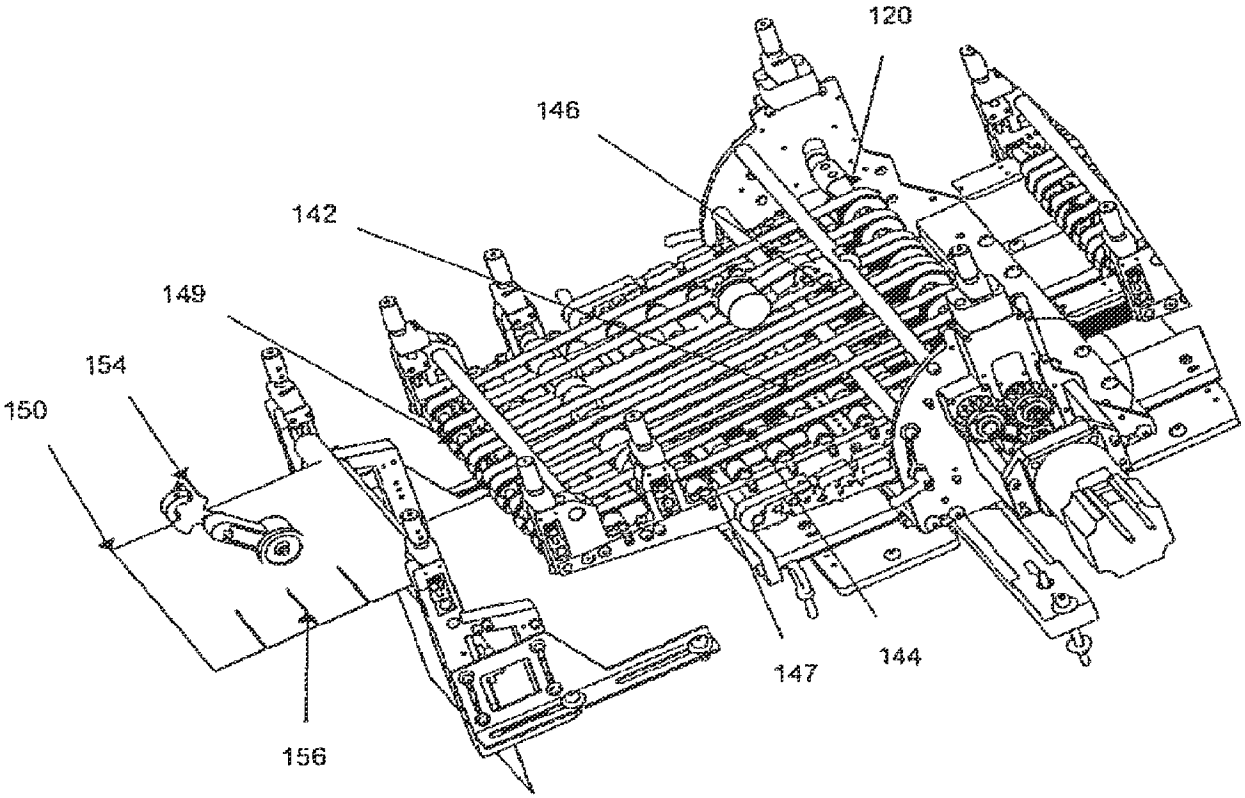
FIG. 3 is a close-up perspective view showing placement of the lugged belts relative to the sheet transport belt.

Positioned beneath the mating flights of the upper and lower transport belt sets are a pair of endless belts 142 and 144 (FIG. 3) having regularly-spaced lugs, as at 146, projecting upward from an upper flight thereof. The lugged belts 142 and 144 are adjusted at the time of initial setup such that the lugs 146 on each are laterally aligned with one another defining a line that is exactly parallel to the nose rollers 134 and 136.

Figure 5:
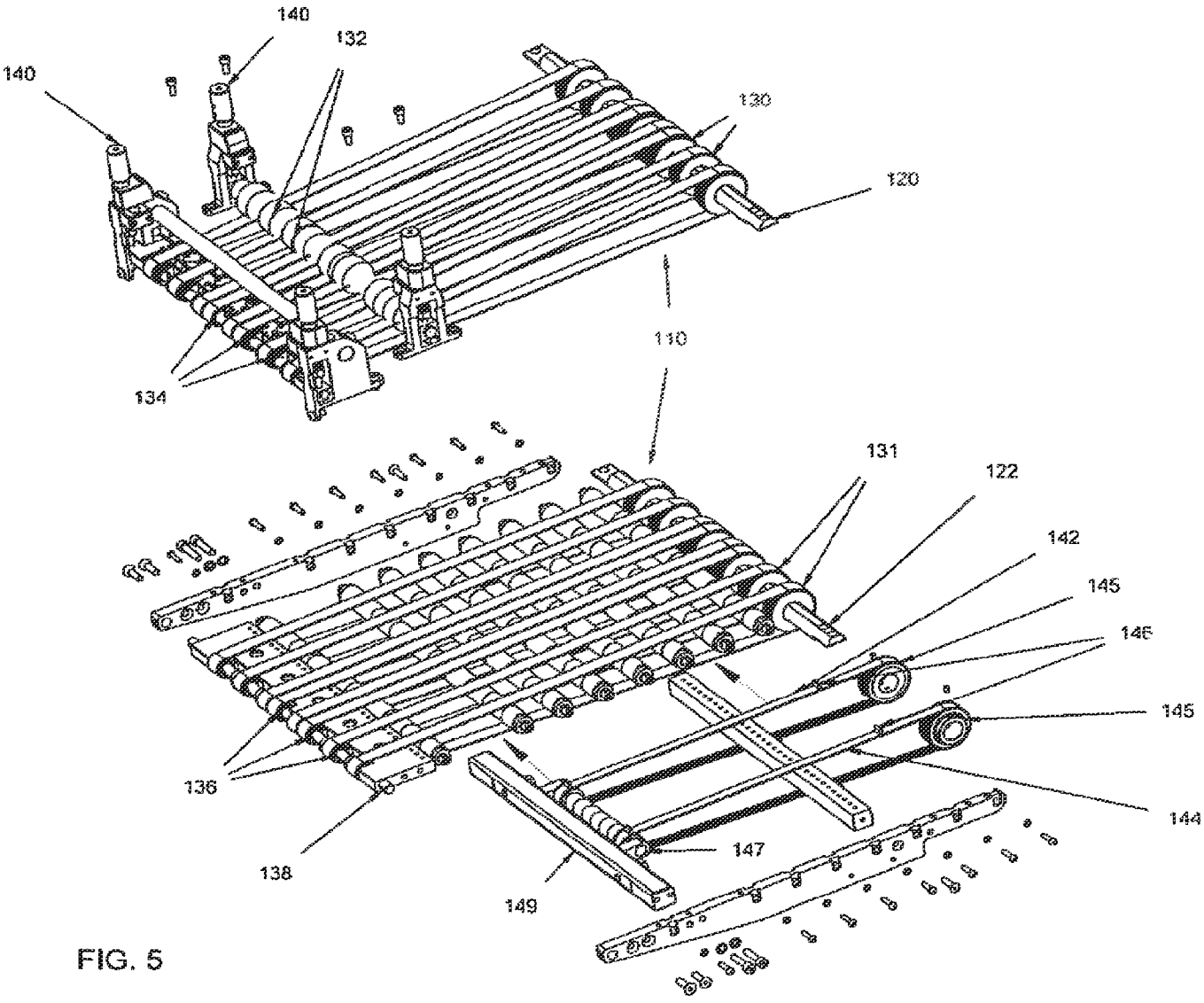
FIG. 5 is an exploded drawing of a second stage discharge conveyor incorporating the present invention.

As see in FIG. 5, the lugged belts 142 and 144 are deployed first about a pair of sheaves 145 on the driven shaft 122 and about a timing belt delivery shaft 147 mounted on and rearwardly offset from a spring-loaded belt tension bar 149. Shaft 147 is located upstream from the nose rollers 134 and 136 such that the lugs on the timing belts 142 and 144 reverse direction of travel before reaching a point where they can interfere with the delivery of sheets from between the upper and lower belt sets at the pinch point 149 between nose rollers 134 and 136.

An important feature of the present invention is that by controlling the relative speeds of the lugged timing belts and the upper and lower transport belts, sheets misaligned and poorly spaced with respect to one another as they exit the first stage discharge conveyor can be brought into precise registration prior to reaching the discharge end of the second stage discharge conveyor. This is achieved by making the diameter of the timing belt sheaves 145 on shaft 122 smaller than the diameter of the flat transport belt sheaves 131 on the same shaft so that the lugged timing belts run slightly slower (approximately 20% slower) than the transport belt sets. As a result, when sheets are fed to the second stage discharge conveyor, they will be made to move in a downstream direction slightly faster than the speed of travel of the lugged timing belts and, as such, a point is reached where the leading edge of the sheets will come into contact with trailing edges of an aligned pair of lugs on the pair of lugged timing belts 142 and 144. Thus, a uniform spacing between adjacent sheets is achieved and the sheets are squared prior to their discharge onto the moving web 150.

To assure accurate placement of sheet products on the moving web 150, certain constraints must be followed. First, the distance from the pinch point of the first stage feeder discharge 108 to the lugged belts 142, 144 should equal the length of the products being fed. An accurately machined lead screw 151 (FIG. 2) is operatively coupled between the first and second discharge belt to provide ease of setting this distance. Likewise, the distance from the pinch point 149 of the second stage discharge conveyor 110 to the nip point of the roller 152 of the moving web 150 should also be set at one product length.

The speed of the non-lugged driven upper and lower discharge belts is appropriately synchronized to that of the moving web 150. To this end, the moving web is provided with registration marks 156 which when passing a suitable photo sensor produce positional information. An encoder 154 is mounted with respect to the web to detect its speed. Likewise, the encoder 148 monitors the speed of the driven discharge conveyor 110. Information from the position sensor and from these two encoders is fed to the controller module 106 which, in turn, controls the motor 124 to maintain a synchronized ration between the speed of web 150 and the discharge conveyor belts whereby products arrive precisely at the registration marks on the web and at a speed of the moving web.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. Apparatus for accurately depositing sheet articles on a moving web comprising:

(a) a sheet friction feeder for feeding sheet articles from the bottom of a stack of such articles, said friction sheet feeder including a first discharge conveyor having upper and lower vertically aligned endless belts with adjacent flights moving in the same direction and at the same speed for transporting sheets therebetween to a discharge pinch point;

(b) a second discharge conveyor having upper and lower endless transport belts with adjacent flights adapted to be driven in the same direction at a predetermined speed and positioned downstream of the pinch point of the first discharge conveyor for receiving sheets leaving the first discharge conveyor between the adjacent flights of the belts of the second discharge conveyor, the second discharge conveyor further including a set of endless belts having regularly spaced lugs projecting normally from a surface thereof and located beneath the adjacent flights of the upper and lower endless belts of the second discharge conveyor, the set of endless lugged belts adapted to be driven at a speed that is a predetermined ratio less than said predetermined speed;

(c) means for synchronizing the predetermined speed of the adjacent flights of the upper and lower endless transport belts of the second discharge conveyor to the speed of a moving web on which the sheet articles are to be deposited, said means including:

(i) a first encoder operatively coupled to sense the speed of the upper and lower endless transport belts of the second discharge conveyor;

(ii) a second encoder operatively coupled to sense the speed of the moving web; and (iii) a digital controller coupled to receive signals from the first and second encoders and produce a control signal for a drive motor for the upper and lower endless transport belts of the second discharge conveyor.

2. The apparatus of claim 1 wherein the adjacent flights of the upper and lower endless transport belts of the second discharge conveyor exceed the length of a flight of the lugged belts by at least a height dimension of said lugs.

3. The apparatus as in claim 1 wherein the relative speed between the upper and lower endless belts of the second discharge conveyor and the endless lugged belts is such that sheet products being fed between adjacent flights of the upper and lower endless belts of the discharge conveyor arrive at a trailing edge of an aligned pair of lugs on the set of endless belts with the regularly spaced lugs prior to reaching a downstream end of the upper and lower endless transport belts of the second discharge conveyor.

* * * * *